United States Patent [19]

Sharrow

[11] 4,139,956

[45] Feb. 20, 1979

[54] SLING IDENTIFICATION MEANS

[75] Inventor: Lawrence L. Sharrow, Circle Pines, Minn.

[73] Assignee: C. C. Sharrow Company, Inc., St. Paul, Minn.

[21] Appl. No.: 823,584

[22] Filed: Aug. 11, 1977

[51] Int. Cl.[2] ..... G09F 3/00

[52] U.S. Cl. ..... 40/316

[58] Field of Search ..... 40/2, 316, 2.2

[56] References Cited

U.S. PATENT DOCUMENTS

| | | | |
|---|---|---|---|
| 885,695 | 4/1908 | Jewett | 40/316 |
| 1,216,964 | 2/1917 | Dodge | 40/316 |
| 1,635,739 | 7/1927 | Brewster | 40/316 |
| 1,841,476 | 1/1932 | Griffin | 40/316 |

*Primary Examiner*—Russell R. Kinsey
*Assistant Examiner*—Wenceslao J. Contreras
*Attorney, Agent, or Firm*—Jacobson and Johnson

[57] ABSTRACT

A means for identifying slings of a particular manufacturer comprises an integral identification member having at least one end of the member integrally formed into the junction of the eye of the sling and a second identification member attached to the integral identification member.

1 Claim, 5 Drawing Figures

SLING IDENTIFICATION MEANS

BACKGROUND OF THE INVENTION

1. Field of the Invention — This invention relates generally to slings and more specifically to permanent sling identification means that allow a manufacturer to identify the manufacturer's sling even though a portion of the identification member has been removed from the sling.

2. Description of the Prior Art — In the lifting and moving of an object it is common to use a sling which has some type of an eye or loop thereon for fastening to a hoist or the like. The use of eyes in slings is well known and old in the art. However, one of the sling manufacturer's problems with the manufacture and sale of slings is the identification of the manufacturer's sling for product liability purposes. This problem is brought about by the manufacture of similar cable or similar slings by other manufacturers. In order to distinguish and identify a particular manufacturer's sling, it is necessary to have some permanent means for identifying the the sling. The use of conventional means such as color coding and the like are ineffective because colors usually wear off with use. In addition, the attachment of any identification tag to the loop of the eye itself has been found ineffective because users will oftentimes cut the tag off or the tag will be torn off during use. The present invention comprises the discovery that the use of a member which is fastened integrally to the junction of the members of the eye provides a permanent identification for the sling that cannot be removed without destroying the sling.

BRIEF SUMMARY OF THE INVENTION

Briefly, the present invention comprises identification means which is permanently attached to the junction formed by the eye of the sling and the main cable of the sling. The identification member is integrally mounted at the junction of the eye and the cable so that the only way the identification member can be totally removed is by destruction of the sling itself.

DESCRIPTION OF THE PREFERRED EMBODIMENT

Figure 1:
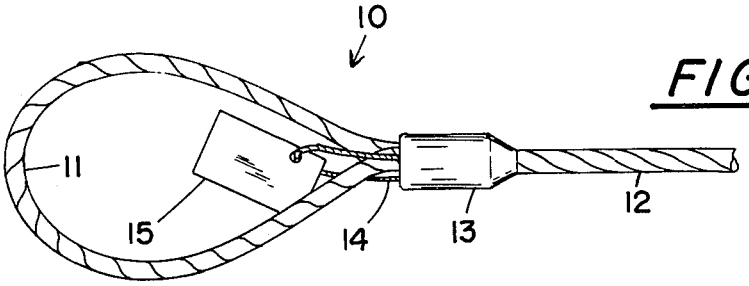
FIG. 1 is a swaged eye showing the identification member attached thereto.

Referring to FIG. 1, reference numeral 10 generally designates a swaged eye sling comprised of a multiple strand wire cable 12 and an eye 11 which has an end which is fastened to main cable 12 through a compression member 13 to form a load bearing loop or eye 11. Compression member 13 contains the end of eye 11, main cable 12, and a separate smaller non-load bearing identification member 14 which passes through an identification member or tag 15. In the preferred embodiment both ends of member 14 extend into member 13 and are integrally formed and compressed therein so they cannot be removed therefrom without destroying sling 10.

It should be noted that the diameter of identification member 14 is substantially smaller than the diameter of cable 12. Identification member 14 also has a substantially smaller loop than the eye of sling 10. One of the purposes of having a small diameter identification member 14 is to allow member 14 to be integrally formed in existing sling assemblies without having to resize compression member 13. Another reason is that identification member 14 does not have to support any load. Identification member 14 may be a single strand of material or multi-stranded material. One feature of the present invention is that the identification member 14 can be made from a material such as a specific metal alloy which is identifiable either on microscopic analysis or chemical analysis. This allows for identification of even a portion of identification member 14 should identification member 14 and identification tag 15 be cut from sling 10. Thus, it is apparent that the present invention provides two means of identifying the manufacturer's product, i.e., an identification tag 15 and an identification means 14 which is nonremovable and identifiable through visual inspection or analysis of the composition of identification member 14. The identification means 14 becomes an integral part of the sling although it is a nonload bearing portion of the sling.

Figure 2:
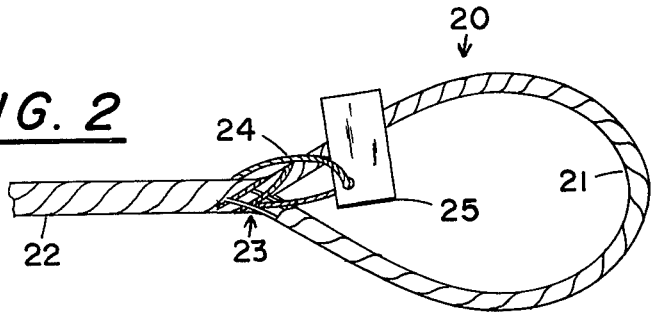
FIG. 2 is a hidden tuck sling showing the identification member attached thereto.

FIG. 2 shows a hidden tuck sling identified by reference numeral 20 to comprise a main cable 22 having a member 21 that is woven into the main body of cable 22 at junction 23. Also located at junction 23 is an identification member 24 which loops through an identification tag 25. Similar to the embodiment of FIG. 1, member 24 is integrally formed into main cable 22 to become an integral part thereof so it cannot be totally removed without destroying the sling.

Figure 3:
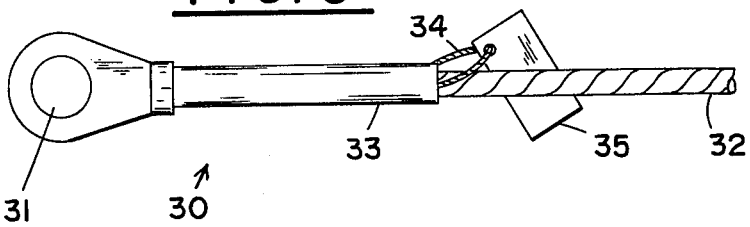
FIG. 3 is a swage socket sling showing the identification member attached thereto.

FIG. 3 shows a swage socket 30 comprised of an eye 31 and a neck 33 which fastens to main cable 32. Neck 33 not only holds main cable 32 securely therein but also identification member 34 having an identification tag 35 thereon.

Figure 4:
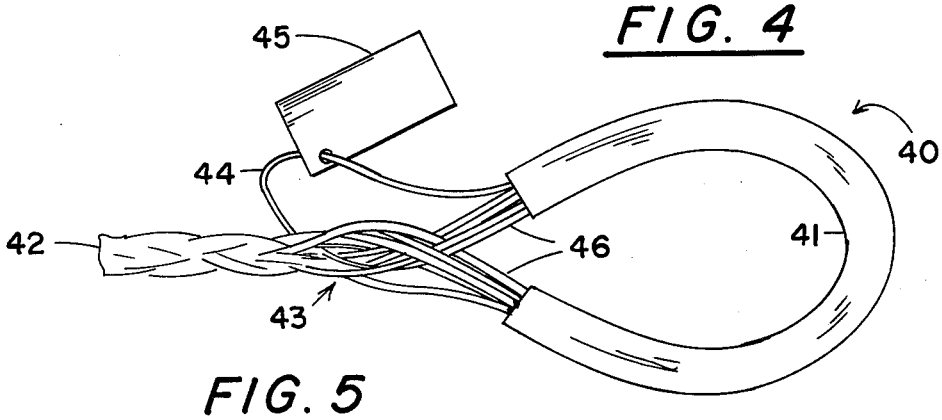
FIG. 4 is a braided sling showing the identification member thereto.

FIG. 4 shows a braided sling 40 comprised of a main multiple strand cable 42 and cable end 46 which is braided into cable 42 at junction 43. A protective shield 41 protects the eye of braided sling 40 from excessive wear. An identification member 44 is integrally attached to cable 42 at junction 43. Fastened to identification member 44 is an identification tag 45.

Figure 5:
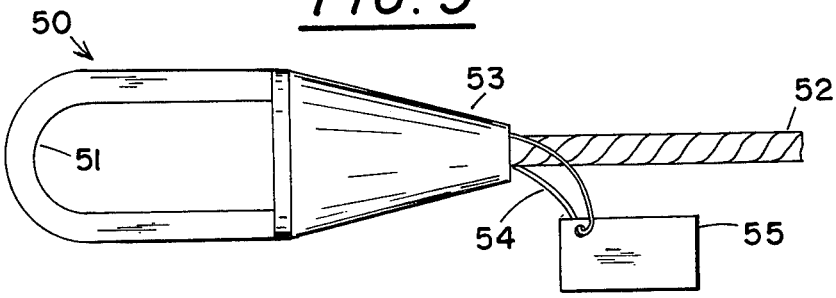
FIG. 5 is a spelter socket showing the identification means fastened thereto.

FIG. 5 shows still another embodiment of the present invention and identifies a spelter socket 50 having an eye 51 for attaching to a hook or the like. Located attached to the housing 53 of spelter socket 50 is a cable 52. Located in the junction of cable 52 and housing 53 is an identification member 54 having an identification tag 55 attached thereto.

It is apparent that with each of these inventions the identification means is formed integrally with the sling itself and becomes an integral part of the sling. The identification means is generally formed of a material or cable which is substantially less than the diameter of the main cable and also of a specific alloy material which allows for proper chemical or microscopic identification. It should be understood that any type of material is suitable for identification as long as it has some identifiable uniqueness in its structure or its composition. For certain applications organic materials would be usable, however, for general use metals or metal alloys are preferred.

Accordingly, the present invention provides means for identifying of the manufacturer's sling should someone intentionally or accidentally tear off the identification tag. In addition, because the integral identification member can only be cut off outside the junction of the cable with the eye, there will always be a portion of the identification loop left in the sling. Consequently, by marking an identification member or loop of a specific material which can be identified by chemical analysis or microscopic analysis, the manufacturer can determine whether or not a sling returned to him was of his manufacture. Accordingly, it should be understood that the present invention can be used with a variety of different type of slings to provide a positive identification through an identification member which is integrally formed to the sling itself and an identification tag which fastens to the identification member.

I claim:

1. A sling having a product identification means thereon, said sling operable for use in moving an object and comprising: a first elongated tension member of predetermined diameter for placing around an object, said first elongated tension member comprising a multiple strand wire cable; an eye for connecting to a hook or the like, said eye integrally connected to said elongated tension member; a first product identification means fastened to said sling at the junction of said eye and said elongated tension member, said first product identification means integrally fastened to the junction of said first elongated tension member and said eye so that said first product identification means cannot be removed therefrom without destroying said sling, said first product identification means comprising a strand of material having a composition which is identifiable through microscopic or chemical analysis to thereby permit identification of said sling; a second product identification means fastened to said first product identification means, said second product identification means comprising a tag having a surface thereon for an identifying indicia, said second product identification means thereby providing a primary method of identification of the sling and said first identification means providing a secondary means for identification of the sling should said first identification means be removed from said sling.

* * * * *

UNITED STATES PATENT OFFICE

CERTIFICATE OF CORRECTION

Patent No. 4,139,956 Dated February 20, 1979

Inventor(s) Lawrence L. Sharrow

It is certified that error appears in the above-identified patent and that said Letters Patent are hereby corrected as shown below:

In claim 1, line 19, after the word first add --product--

In claim 1, line 21, change "first" to --second product--

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*